US006493891B1

(12) United States Patent
Livingston

(10) Patent No.: US 6,493,891 B1
(45) Date of Patent: Dec. 17, 2002

(54) COMBINATION PILLOW AND TOTE BAG

(76) Inventor: Lucy J. Livingston, 1608 Day Star Dr., Dallas, TX (US) 75224

( * ) Notice: Subject to any disclaimer, the term of this patent is extended or adjusted under 35 U.S.C. 154(b) by 117 days.

(21) Appl. No.: 09/666,921

(22) Filed: Sep. 21, 2000

(51) Int. Cl.[7] ..... A47G 9/00; A47C 9/00

(52) U.S. Cl. ..... 5/636; 420/640; 150/110; 190/1; 383/4; 383/25

(58) Field of Search ..... 5/417–420, 636, 5/639, 640; 383/4, 25; 190/1, 2; 150/110

(56) References Cited

U.S. PATENT DOCUMENTS

| | | | | | |
|---|---|---|---|---|---|
| 4,154,323 | A | * | 5/1979 | Sneider | 190/2 |
| 4,164,275 | A | * | 8/1979 | Davis | 5/417 |
| 4,194,601 | A | * | 3/1980 | Yellin | 190/2 |
| 4,375,111 | A | * | 3/1983 | Hall | 5/420 |
| 4,466,517 | A | * | 8/1984 | Spiegelman | 190/2 |
| 4,535,878 | A | | 8/1985 | Grahl | |
| 4,597,605 | A | | 7/1986 | Gilbert | |
| 4,863,003 | A | | 9/1989 | Carter | |
| 5,010,610 | A | * | 4/1991 | Ackley | 5/420 |
| 5,119,519 | A | | 6/1992 | Foreman | |
| D366,800 | S | | 2/1996 | Moore, Jr. | |
| D376,689 | S | * | 12/1996 | Doppelt | D3/273 |
| 5,778,468 | A | | 7/1998 | Saarela et al. | |
| 5,785,219 | A | * | 7/1998 | Kraft | 5/419 |
| 5,918,332 | A | * | 7/1999 | Dees | 383/4 |

FOREIGN PATENT DOCUMENTS

| | | | | |
|---|---|---|---|---|
| FR | 2345101 | * | 10/1977 | 150/110 |
| FR | 2394268 | * | 1/1979 | 150/110 |

* cited by examiner

*Primary Examiner*—Alexander Grosz

(57) ABSTRACT

A combination pillow and tote bag for holding a pillow and other items for easy carrying and transportation. The combination pillow and tote bag includes a tote portion. The tote portion comprises a back panel and a front panel. The front and back panels each have a top edge, a bottom edge and a pair of side edges. The bottom edge of the front panel is securely attached to the bottom edge of the back panel. Each of a pair of side panels is securely attached to one of side edges of each of the front and back panels such that a bag is defined. A carrying means for carrying the tote portion comprises a strap having a pair of ends each securely attached to the tote portion. A pillow portion may be removably inserted in the tote portion.

7 Claims, 4 Drawing Sheets

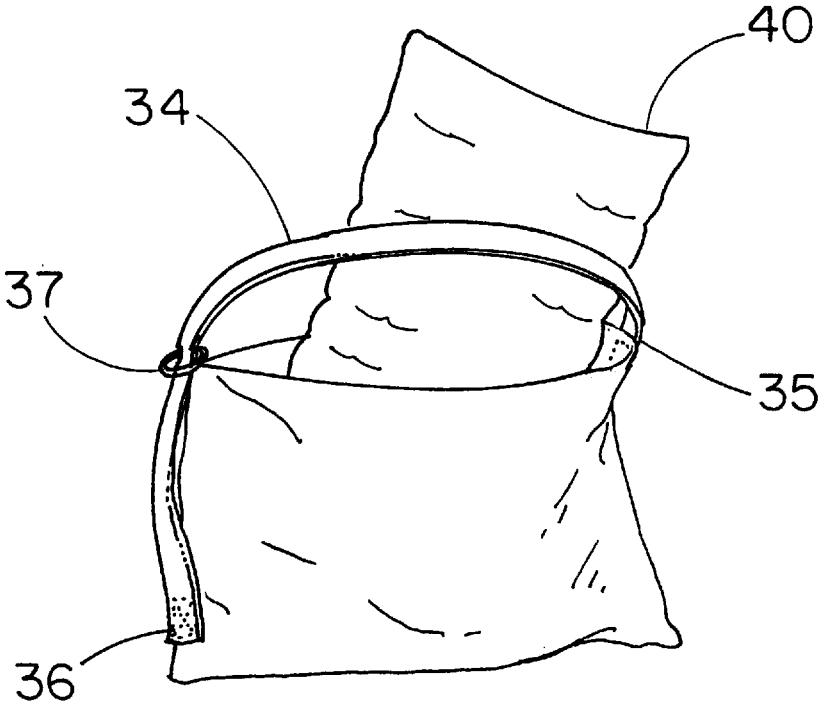
FIG. 1
FIG. 2
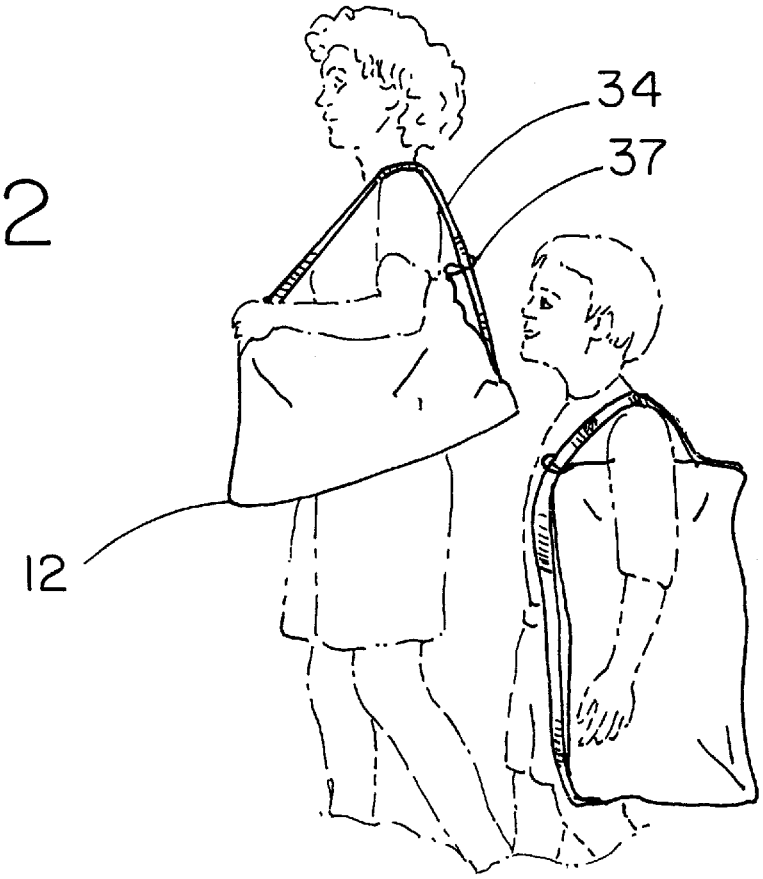

COMBINATION PILLOW AND TOTE BAG

BACKGROUND OF THE INVENTION

1. Field of the Invention

The present invention relates to tote bags and more particularly pertains to a new combination pillow and tote bag for holding a pillow and other items for easy carrying and transportation.

2. Description of the Prior Art

The use of tote bags is known in the prior art. More specifically, tote bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,119,519; U.S. Pat. No. 4,963,003; U.S. Pat. No. 4,535,878; U.S. Pat. No. 5,778,468; U.S. Pat. No. 4,597,605; and U.S. Des. Pat. No. 366,800.

While these devices fulfill their respective, particular objectives and requirements, the aforementioned patents do not disclose a new combination pillow and tote bag. The inventive device includes a tote portion. The tote portion comprises a back panel and a front panel. The front and back panels each have a top edge, a bottom edge and a pair of side edges. The bottom edge of the front panel is securely attached to the bottom edge of the back panel. Each of a pair of side panels is securely attached to one of side edges of each of the front and back panels such that a bag is defined. A carrying means for carrying the tote portion comprises a strap having a pair of ends each securely attached to the tote portion. A pillow portion may be removably inserted in the tote portion.

In these respects, the combination pillow and tote bag according to the present invention substantially departs from the conventional concepts and designs of the prior art, and in so doing provides an apparatus primarily developed for the purpose of holding a pillow and other items for easy carrying and transportation.

SUMMARY OF THE INVENTION

In view of the foregoing disadvantages inherent in the known types of tote bags now present in the prior art, the present invention provides a new combination pillow and tote bag construction wherein the same can be utilized for holding a pillow and other items for easy carrying and transportation.

The general purpose of the present invention, which will be described subsequently in greater detail, is to provide a new combination pillow and tote bag apparatus and method which has many of the advantages of the tote bags mentioned heretofore and many novel features that result in a new combination pillow and tote bag which is not anticipated, rendered obvious, suggested, or even implied by any of the prior art tote bags, either alone or in any combination thereof.

To attain this, the present invention generally comprises a tote portion. The tote portion comprises a back panel and a front panel. The front and back panels each have a top edge, a bottom edge and a pair of side edges. The bottom edge of the front panel is securely attached to the bottom edge of the back panel. Each of a pair of side panels is securely attached to one of side edges of each of the front and back panels such that a bag is defined. A carrying means for carrying the tote portion comprises a strap having a pair of ends each securely attached to the tote portion. A pillow portion may be removably inserted in the tote portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination pillow and tote bag apparatus and method which has many of the advantages of the tote bags mentioned heretofore and many novel features that result in a new combination pillow and tote bag which is not anticipated, rendered obvious, suggested, or even implied by any of the prior art tote bags, either alone or in any combination thereof.

It is another object of the present invention to provide a new combination pillow and tote bag which may be easily and efficiently manufactured and marketed.

It is a further object of the present invention to provide a new combination pillow and tote bag which is of a durable and reliable construction.

An even further object of the present invention is to provide a new combination pillow and tote bag which is susceptible of a low cost of manufacture with regard to both materials and labor, and which accordingly is then susceptible of low prices of sale to the consuming public, thereby making such combination pillow and tote bag economically available to the buying public.

Still yet another object of the present invention is to provide a new combination pillow and tote bag which provides in the apparatuses and methods of the prior art some of the advantages thereof, while simultaneously overcoming some of the disadvantages normally associated therewith.

Still another object of the present invention is to provide a new combination pillow and tote bag for holding a pillow and other items for easy carrying and transportation.

Yet another object of the present invention is to provide a new combination pillow and tote bag which includes a tote portion. The tote portion comprises a back panel and a front panel. The front and back panels each have a top edge, a bottom edge and a pair of side edges. The bottom edge of the front panel is securely attached to the bottom edge of the back panel. Each of a pair of side panels is securely attached to one of side edges of each of the front and back panels such that a bag is defined. A carrying means for carrying the tote portion comprises a strap having a pair of ends each securely attached to the tote portion. A pillow portion may be removably inserted in the tote portion.

Still yet another object of the present invention is to provide a new combination pillow and tote bag that allows a user to conveniently carry a pillow and a covering.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side view of a new combination pillow and tote bag according to the present invention.

FIG. 2 is a schematic side view of the present invention.

DESCRIPTION OF THE PREFERRED EMBODIMENT

Figure 3:
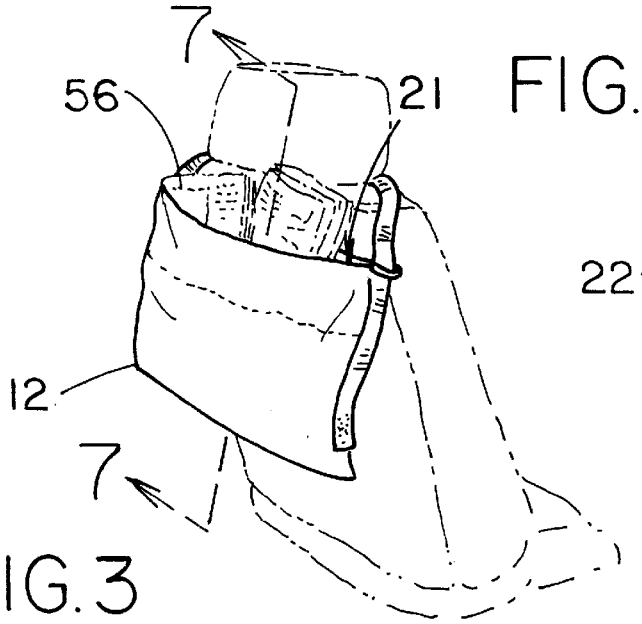
FIG. 3 is a schematic perspective view of the present invention.
Figure 7:
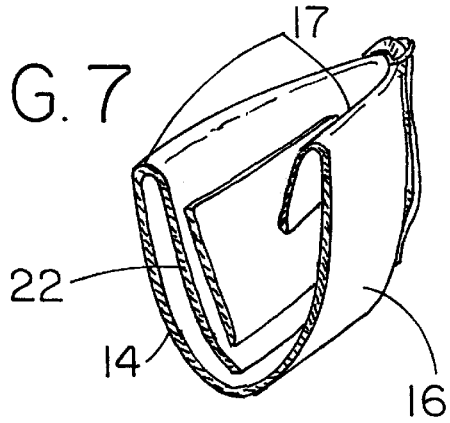
FIG. 7 is a schematic cross-sectional perspective view of the present invention.
Figure 4:
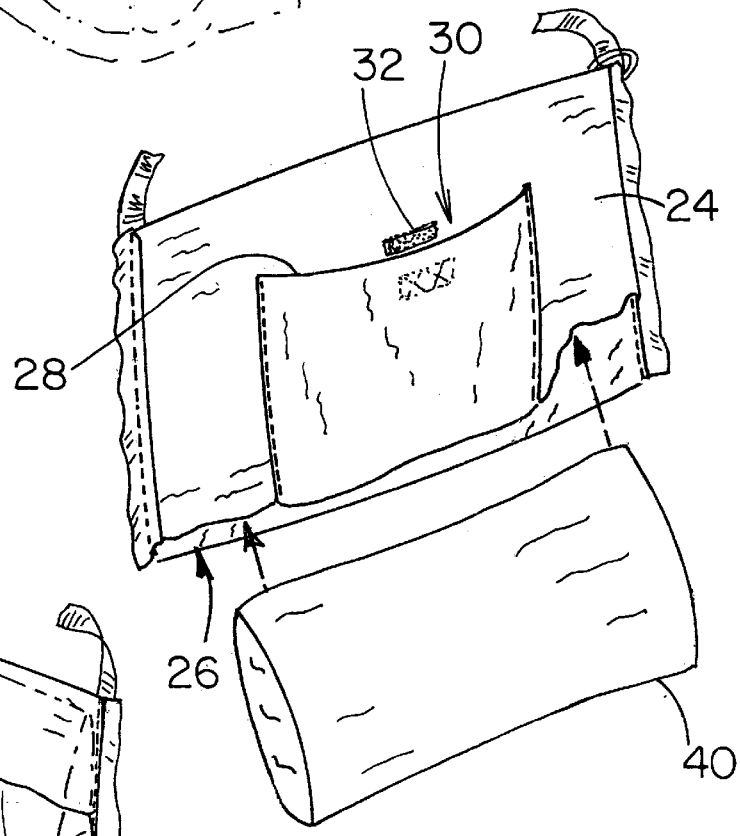
FIG. 4 is a schematic perspective view of the covering means of the present invention.

With reference now to the drawings, and in particular to FIGS. 1 through 8 thereof, a new combination pillow and tote bag embodying the principles and concepts of the present invention and generally designated by the reference numeral 10 will be described.

As best illustrated in FIGS. 1 through 8, the combination pillow and tote bag 10 generally includes tote portion 12. The tote portion 12 comprises a back panel 14 and a front panel 16. The front 16 and back 14 panels each have a top edge 17, a bottom edge 18 and a pair of side edges 19. The bottom edge 18 of the front panel 16 is securely attached to the bottom edge 18 of the back panel 14. Each of a pair of side panels 20 is securely attached to one of side edges 19 of each of the front 16 and back 14 panels such that a bag is defined having an opening 21 adjacent to the top edges 17 of the front 16 and back 14 panels. The front 16, back 14 and side panels 20 each comprise a cloth material.

A cover member 22 covers the opening 21 in the tote portion 12. The cover member 22 is securely coupled to the top edge 17 of the back panel 14. The cover member 22 comprises a substantially rectangular panel. In one embodiment, shown in FIG. 4, the cover member has a flap 24 securely attached to it to form a pocket. The flap 24 preferably has an opening 26 for removably placing a pillow 40 therein. The flap 24 may also be securely closed once the pillow 40 is therein such that pillow 40 may not be removed.

A pocket 28 is securely connected to an outside surface of the cover member 22. The pocket 28 ideally has an opening 30 therein which may be selectively closed using a hook and loop fastening means 32.

A carrying means for carrying the tote portion 12 comprises a strap 34. The strap 34 is a flexible elongate member having a first end 35 a second end 36. The first end 35 is securely attached to a first of the side panels 20 and is positioned generally adjacent to the top edges 17 of the front 16 and back 14 panels. The second end 36 of the strap 34 is securely attached to a second of the side panels 20 and is positioned generally adjacent to a bottom edge 18 of the front 16 and back 14 panels. A ring 37 member is pivotally coupled to the second side panel and positioned generally adjacent to the top edges 17 of the front 16 and back 14 panels. The strap 34 is extended through the ring member 37. The ring 37 allows for carrying the tote portion 12 in two different positions as are depicted in FIG. 2. FIG. 3 shows the strap 34 being used to hang the tote member 12 over the head rest of a car seat.

"An elongate panel 44 has a first edge 46 and a second edge 48. The elongate panel 44 also has a top side 50 and a bottom side 52. The first edge 46 is integrally coupled to the top edge 17 of the front panel 16. The elongate panel 44 has a length greater than three feet. The elongate panel 44 preferably comprises a cloth material. The cloth material is ideally a cotton terry cloth material."

An elongate flexible member 60 is securely attached to and extending between lateral side edges 47 of the elongate panel 44. The elongate flexible member is generally positioned adjacent to the front panel 16.

A pillow portion 40, comprising a pillow and having a conventional cushioning material therein, is removably position in the tote portion.

Figure 5:
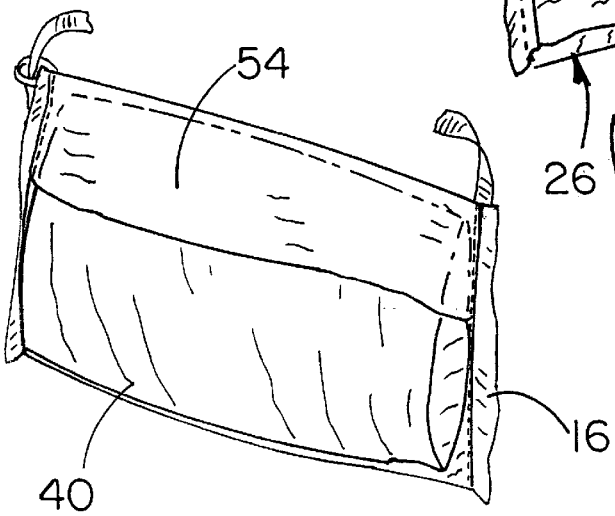
FIG. 5 is a schematic perspective view of the inside of the front panel of the present invention.

Another embodiment, shown in FIG. 5, has a flap 54 sewn to the inner side of the front panel 16. The flap 54 is generally adjacent to the top edge 17 of the front panel 16 and extends downward less than half of the distance between the top 17 and bottom 18 edges. The pillow 40 may be placed under the flap 54 to hold it securely in place.

Figure 8:
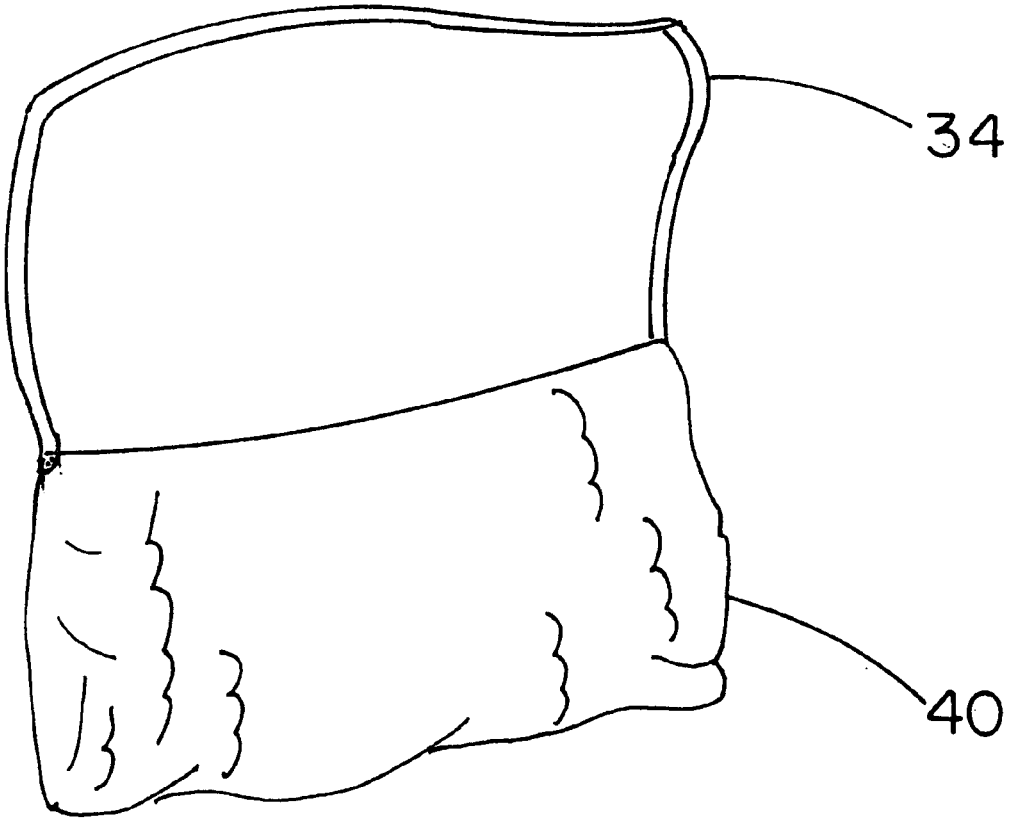
FIG. 8 is a schematic side view of the present invention.

A third embodiment, shown in FIG. 8, includes only the pillow portion 40 and the carrying means. The strap 34 of the carrying means is securely attached to the pillow 40 for easy carrying of the same.

Figure 6:
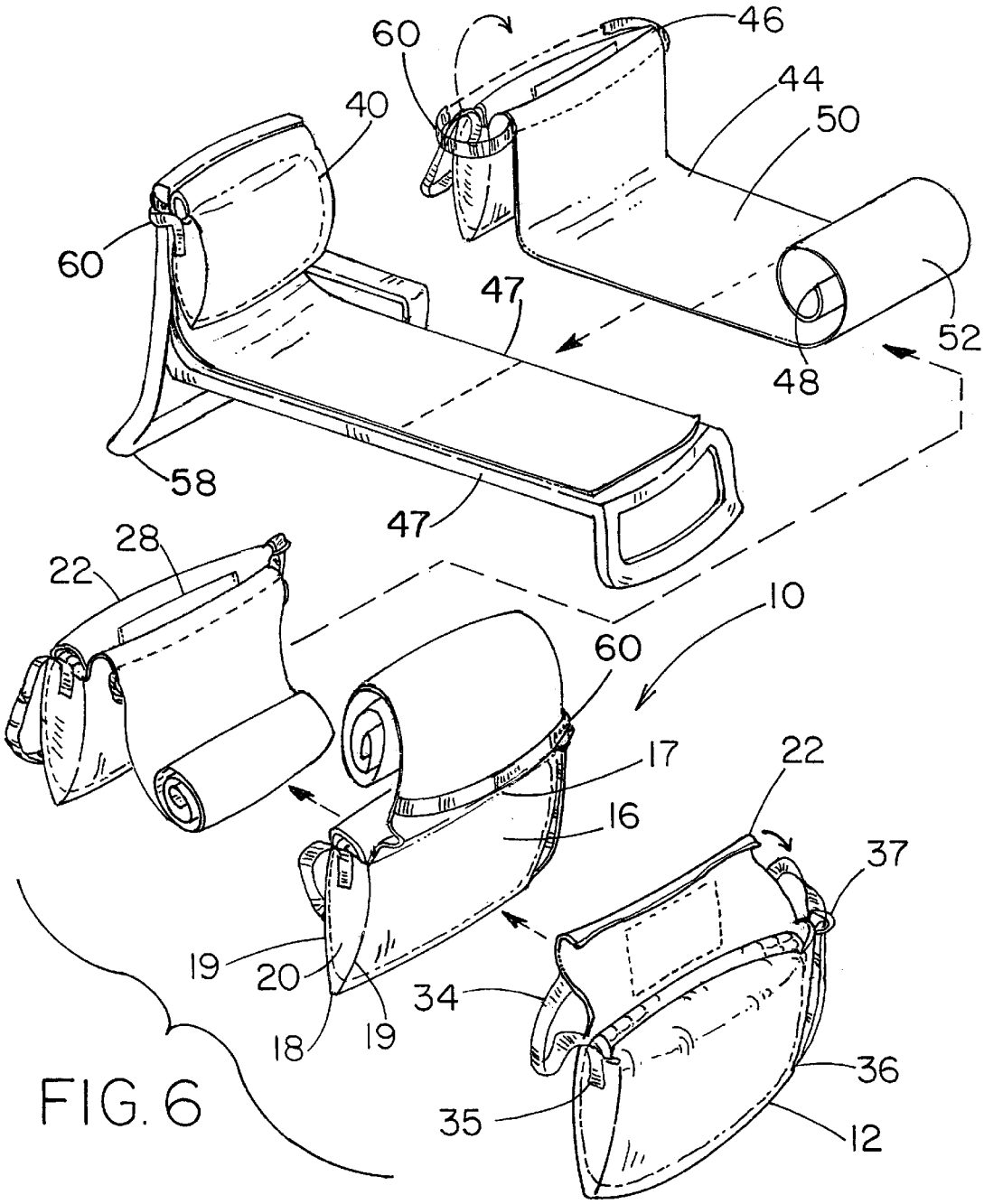
FIG. 6 is a schematic perspective view of the present invention.

The preferred use is demonstrated in FIG. 6. The elongate panel 44 is rolled up and the elongate panel 44 and pillow 40 are placed in the tote portion 12 as shown in FIG. 6. Goods or items 56 may be placed between the rolled up elongate panel 44 and the back panel 14 to use as a conventional tote bag. The covering member 22 is placed over the opening of the tote portion and may be positioned over any item found with in the tote portion when the elongate panel 44 is removed. The elongate panel 44 is rolled out, it may be placed over a chair 58. The elongate flexible member is positioned about the top portion of the chair 58 so that the tote portion is in a location for use by the user's head. The person may thus lie upon the panel 44 while using the tote portion 12 and pillow therein for resting their head.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pillow and tote combination device, said device comprising:

a tote portion, said tote portion comprising a back panel, and a front panel, said front and back panels each having a top edge, a bottom edge and a pair of side edges, said bottom edge of said front panel being securely attached to said bottom edge of said back panel, each of a pair of side panels being securely attached to one of side edges of each of said front and back panels such that a bag is defined;

a carrying means for carrying said tote portion, said carrying means comprising a strap having a pair of ends each securely attached to said tote portion;

a pillow portion, wherein said pillow portion may be removably inserted in said tote portion; and said first end of said strap being securely attached to a first of said side panels and positioned generally adjacent to said top edges of said front and back panels, said second end of said strap being securely attached to a second of said side panels and positioned generally adjacent to a bottom edge of said front and back panels, a ring member being pivotally coupled to said second side panel and positioned generally adjacent to said top edges of said front and back panel, wherein said strap is extended through said ring member.

2. The pillow and tote combination device as in claim 1, further comprising:

a cover member for covering an opening between said top edges of said front and back panels in said tote portion, said cover member being securely coupled to said top edge of said back panel, said cover member comprising a substantially rectangular panel.

3. The pillow and tote combination device as in claim 2, wherein said cover member further comprises:

a flap being fixedly coupled to an inside surface of said cover member, said flap having an opening therein, said opening of said flap being generally adjacent to a free edge of said cover member opposite said top edge of said back panel, said cover member and said flap defining a pocket adapted for removably receiving said pillow portion.

4. The pillow and tote combination device as in claim 2, further comprising:

a pocket, said pocket being securely connected to an outside surface of said cover member.

5. The pillow and tote combination device as in claim 2, further comprising:

an elongated panel, said elongate panel having a first edge and a second edge, said elongate panel having a top side and a bottom side, said first edge being integrally coupled to said top edge of said front panel; and an elongated flexible member, said elongate flexible member being coupled to and extending between lateral side edges of said elongated panel.

6. The pillow and tote combination device as in claim 5, wherein said elongate panel has a length greater than three feet.

7. A pillow and tote combination device, said device comprising:

a tote portion, said tote portion comprising a back panel, and a front panel, said front and back panels each having a top edge, a bottom edge and a pair of side edges, said bottom edge of said front panel being securely attached to said bottom edge of said back panel, each of a pair of side panels being securely attached to one of side edges of each of said front and back panels such that a bag is defined having an opening adjacent to said top edges of said front and back panels, said front, back and side panels comprising a cloth material;

a cover member for covering said opening in said tote portion, said cover member being securely coupled to said top edge of said back panel, said cover member comprising a substantially rectangular panel;

a pocket, said pocket being securely connected to an outside surface of said cover member;

a carrying means for carrying said tote portion, said carrying means comprising a strap, said strap being a flexible elongate member having a first end a second end, said first end being securely attached to a first of said side panels and positioned generally adjacent to said top edges of said front and back panels, said second end of said strap being securely attached to a second of said side panels and positioned generally adjacent to a bottom edge of said front and back panels, a ring member being pivotally coupled to said second side panel and positioned generally adjacent to said top edges of said front and back panel, wherein said strap is extended through said ring member;

an elongate panel, said elongate panel having a first edge and a second edge, said elongate panel having a top side and a bottom side, said first edge being integrally coupled to said top edge of said front panel, said elongate panel having a length greater than three feet;

a pillow portion, said pillow portion comprising a pillow having a cushioning material therein, said pillow being removably positioned in said tote portion; and an elongate flexible member, said elongate flexible member being coupled to and extending between lateral side edges of said elongate panel, said elongate flexible member being generally positioned adjacent to said front panel.

* * * * *